United States Patent [19]

Takahashi et al.

[11] 4,123,330

[45] Oct. 31, 1978

[54] COLOR DIFFUSION TRANSFER PROCESS USING BENZYL ALCOHOL AND DERIVATIVES THEREOF

[75] Inventors: Jiro Takahashi; Akihiko Miyamoto, both of Hino, Japan

[73] Assignee: Konishiroku Photo Industry Co., Ltd., Tokyo, Japan

[21] Appl. No.: 732,210

[22] Filed: Oct. 14, 1976

[30] Foreign Application Priority Data

Oct. 16, 1975 [JP] Japan ..... 50-124727

[51] Int. Cl.[2] ..... G03C 7/00; G03C 5/54

[52] U.S. Cl. ..... 96/29 D; 96/3

[58] Field of Search ..... 96/3, 29 D

[56] References Cited

U.S. PATENT DOCUMENTS

| | | | |
|---|---|---|---|
| 2,983,606 | 5/1961 | Rogers | 96/29 D |
| 3,173,786 | 3/1965 | Green et al. | 96/29 D |
| 3,846,129 | 11/1974 | Kuh | 96/29 D |
| 3,929,485 | 12/1975 | Miyakawa et al. | 96/29 D |

*Primary Examiner*—Richard L. Schilling
*Attorney, Agent, or Firm*—Bierman & Bierman

[57] ABSTRACT

The present invention discloses a process for forming a color dye image in an image receiving layer by diffusion transfer from a light sensitive element containing a diffusible dye developer and a silver halide emulsion which has been imagewise exposed. The exposed light sensitive element is subjected to an alkaline processing solution to transfer the dye developer to an image-receiving layer of an image receiving element to produce a color dye image. The alkaline processing solution thus used should contain a compound of the following general formula:

wherein $R_1$ represents hydrogen, methyl, ethyl, methoxy or hydroxymethyl and $R_2$ represents hydrogen, methyl or ethyl.

6 Claims, No Drawings

COLOR DIFFUSION TRANSFER PROCESS USING BENZYL ALCOHOL AND DERIVATIVES THEREOF

This invention relates to a color diffusion transfer process. More particularly, the invention relates to a color dye developer diffusion transfer process in which the maximum density of an image formed thereby is increased and the processing time necessary therefor is shortened.

A color dye developer diffusion transfer process has been described in many patents, for example, British Pat. No. 804,971. According to this process, a light-sensitive element containing a silver halide emulsion and a diffusible dye developer is exposed to light, thereby forming a latent image in the silver halide, and then the exposed light-sensitive element is processed with an alkaline processing solution. During processing the light-sensitive element with the alkaline processing solution, said element is placed upon an image-receiving element capable of mordanting the dye developer, and unoxidized diffusible dye developers in imagewise distribution are transferred by diffusion to the image-receiving element, thereby to obtain a positive dye image thereon.

In such color diffusion transfer method as referred to above, the dye developer to be transferred by diffusion is required to be sufficiently dissolved in the alkaline processing solution and, moreover, an oxidation product of the dye developer formed in the development reaction, is required to become substantially insoluble in the processing solution. Generally, a dye developer is dissolved by use of such a high boiling solvent, for example, diethyllaurylamide as disclosed in Japanese patent publication No. 1738/1964 and the dissolved dye developer is then dispersed in a gelatin colloid solution to form a dispersion of fine-grained dye developer, or is directly dispersed in such a manner, for example, as disclosed in Japanese patent publication No. 32131/1973 and U.S. Pat. No. 3,832,173, in the gelatin colloid solution. Since the dye developer is incorporated into a light-sensitive element in such the dispersed form as mentioned above when, after imagewise exposure, the light-sensitive element is subjected to development treatment, the dye developer starting from its fine-grained state has to be eluted into a processing solution. As the processing solution usable in such case, there have been known alkaline processing solutions containing, alkali metal hydroxides. When the development treatment was conducted by the use of these processing solutions, however, there were observed such drawbacks that a dye developer was not sufficiently eluted from the fine-grain into the processing solution, so that the transfer rate slowed down and the maximum density of an image formed thereby decreased. Furthermore, in the case of using such dye developers as hydrolyzable dye developers as disclosed in Japanese patent publication No. 379/1961 or shorter-wavelength-shift dye developers, there were observed similarly such drawbacks that the transfer speed slowed down and the maximum density markedly decreased.

An object of the present invention is to remove the above-mentioned drawbacks and is to provide a new color diffusion transfer process in which the maximum density of an image formed and the transfer speed is enhanced by improving a dye developer in elutability into an alkaline processing solution.

Such objects and other objects of the present invention which will be mentioned hereinafter may be accomplished by applying an alkaline processing solution containing a compound represented by the under-mentioned general formula to both an imagewise exposed light-sensitive element containing a dye developer, and an image-receiving element placed upon the light-sensitive element and then transferring said dye developer corresponding to the imagewise exposure onto said image-receiving element, thereby to form a color image thereon.

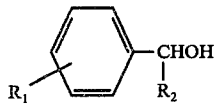

wherein $R_1$ represents hydrogen, methyl, ethyl, methoxy or hydroxymethyl and $R_2$ represents hydrogen, methyl or ethyl.

At least while the alkaline processing solution containing the compound of the above-mentioned general formula is used in the development treatment according to the present invention, the aforesaid light-sensitive element and image-receiving element are contacted each other. Both elements may be separated before and/or after this treatment.

The light-sensitive element of the present invention contains a silver halide emulsion and a dye developer.

The silver halide emulsion is a hydrophilic colloidal dispersion of silver halide including silver bromide, silver iodide, silver chloride, silver iodobromide, silver chlorobromide, silver chloroiodide, silver chloroiodobromide and their mixtures and can be prepared by various processes, for example, any of the processes for preparing the so-called conversion emulsions, Lippmann's emulsions and the like, and grain size, content and mixing ratio of the silver halides are selected within a wide range according to the kind of the desired light-sensitive photographic materials used. As the hydrophilic protective colloid which is a dispersant for the silver halide, there may be used various natural or synthetized colloid substances such as gelatin, polyvinyl alcohol and the like. Such silver halide as explained above can be chemically sensitized by the use of active gelatin; such sulfur sensitizers as allylthiocarbamide, thiourea and cystine and the like; selenium sensitizers; such noble metal sensitizers as gold sensitizer, ruthenium, rhodium and irridium sensitizers, which sensitizers may be used either singly or suitably in combination. Further, the silver halide emulsion may be optically sensitized, for example, by the use of cyanine dyes or merocyanine dyes and thus color light-sensitive elements can usually be prepared from three kinds of silver halide emulsions having their respective light-sensitive wavelength regions different from each other.

The emulsion may also be stabilized by the use of triazoles, azaindenes, quaternary benzothiazolium compounds, zinc or cadmium compounds, and may also contain a sensitizing compound of quaternary ammonium salt type or of polyethylene glycol type. The emulsion may further contain suitable plasticizers for gelatin, such as glycerine; dihydroxyalkane, e.g. 1,5-pentanediol; ester of ethylenebisglycolic acid; bis-ethoxydiethylene glycol succinate; amide of such acid as acrylic acid; or latex; and may also contain gelatin-hardeners such as formaldehyde; a halogen-substituted fatty acid, e.g. mucobromic acid; compounds having acid anhydride groups; dicarboxylic acid chloride; biester of methanesulfonic acid; or sodium bisulfite derivatives of dialdehyde in which the aldehyde groups are separated by 2 to 3 carbon atoms. Further, the emulsion may contain various additives for photographic purposes, such wetting agent as saponin or such coating aid as sulfosuccinate. Still further, the emulsion may contain, if necessary, various additives commonly used in the art of photography, such as antifogging agents, ultraviolet absorbers or the like.

The light-sensitive element of the present invention comprises therein the above-mentioned silver halide emulsion in combination with dye developers.

The dye developers comprise both a chromophore moiety and at least one moiety having a silver halide developing function, such as a hydroquinonyl radical. The latter moiety imparts silver halide developing activity to the dye developer molecule as a whole, so during development of a silver halide image, the dye developers are oxidized to less diffusible compounds and the residual dye developers in the undeveloped regions are transferred as diffusible dyes imagewise to image-receiving layer, to provide a dye image therein.

Any diffusible dye developers known in the art are usable in the invention. The dye developers usable in the present invention include, for example, such compounds as disclosed in U.S. Patent Specifications represented by their respective patent numbers, i.e. U.S. Pat. Nos. 2,983,606; 3,345,163; 3,255,001; 3,135,606; 3,421,892; 3,597,200; 3,563,739; 3,482,972; 3,415,644 and 3,594,165. In the present invention, furthermore, there may be used also hydrolyzable dye developers. These dye developers have hydrolyzable groups in their molecules, so that, as a result of the development, the hydrolyzable groups are cleaved off by hydrolysis, and the hydrolyzed form of the dye developers are, as diffusible dyes, transferred to the image-receiving layer to provide a dye image therein. Among these dye developers, there is also known a shorter-wavelength-shift dye developer, which has, on the chromophore moiety, a hydrolyzable group, which has the effect of shifting the visible absorption toward the shorter wavelengths, such as an acyl radical attached to on amino nitrogen or oxygen on the chromophore moiety through nitrogen or oxygen. In this case, the dye developers undergo a change in structure and color during development, and the changed form of the dye developer which has a color different from that of the dye developer originally present in the sensitive element is transferred, as a diffusible dye, to the image-receiving layer to provide a dye image thereon. Representatives of these dye developers may include such compounds as disclosed in U.S. Pat. Nos. 3,230,082; 3,329,670; 3,307,947 and 3,196,014. Further, such leuco-dye developers, for example, as disclosed in U.S. Pat. No. 2,909,430 and U.S. patent application Ser. Nos. 206,836/1971, now abandoned, and 308,869/1972, now U.S. Pat. No. 3,880,658 and which is a C.I.P. of Ser. No. 206,836, invention. Leuco dye developers are immobilized in the developed regions and imagewise diffuse, as a diffusible dyes, from the undeveloped regions to the image-receiving layer, and are oxidized to form a colored dye image therein.

Examples of these dye developers described in the above specifications are:

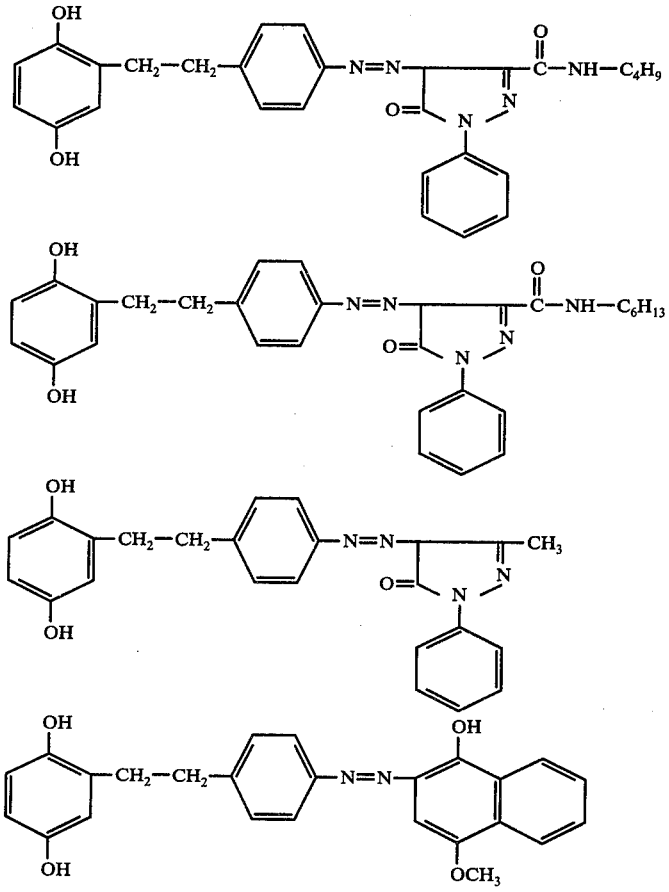

-continued
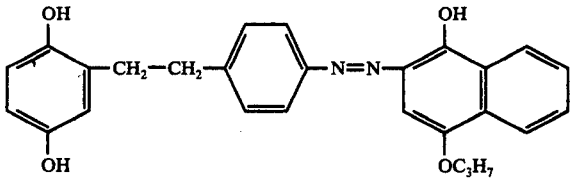
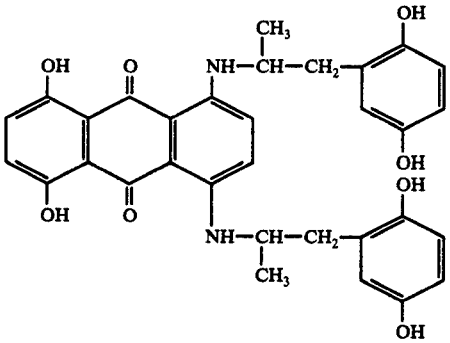
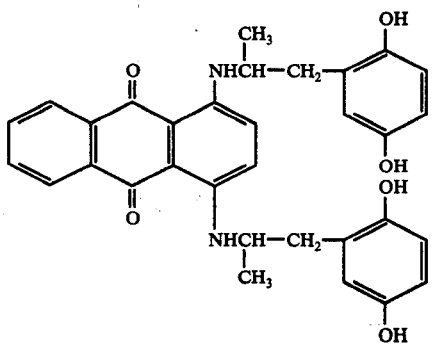
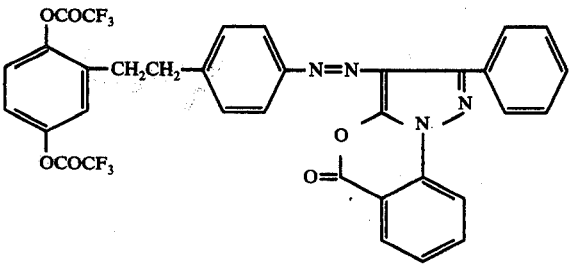
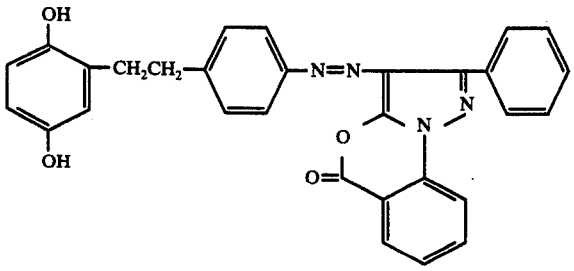
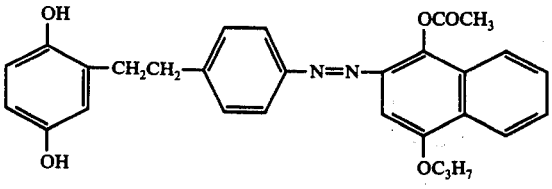

-continued
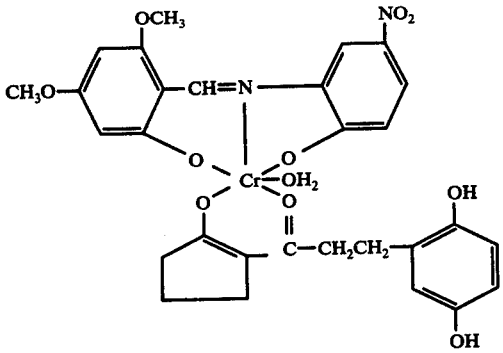
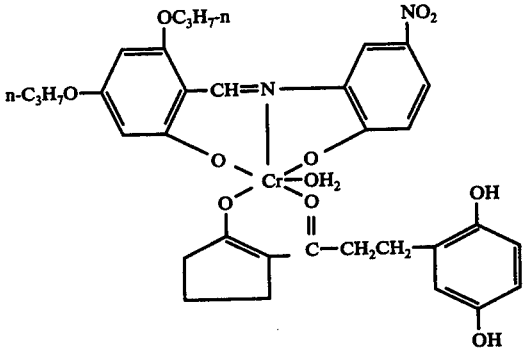
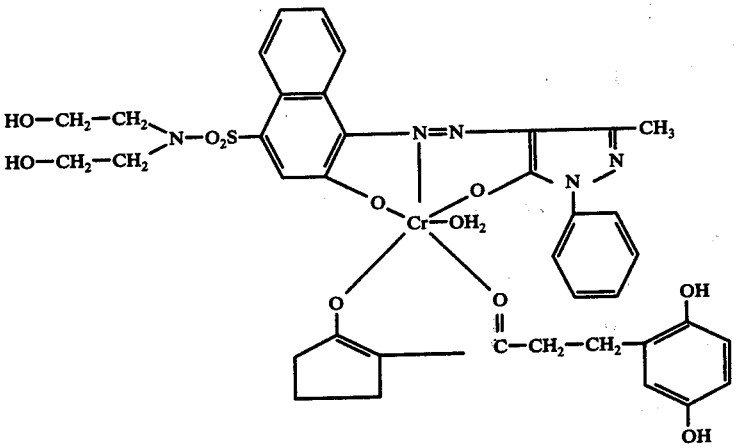
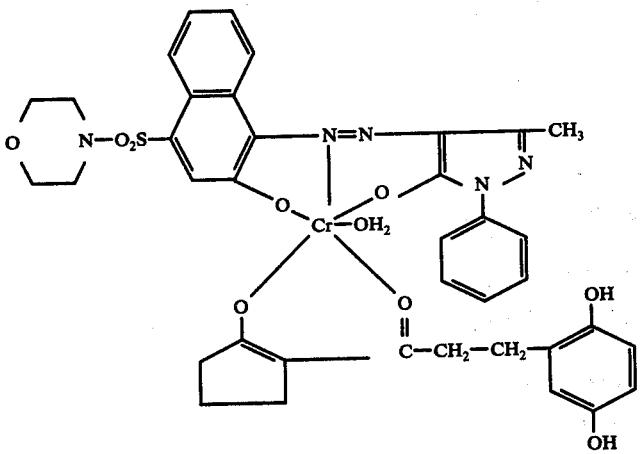

-continued
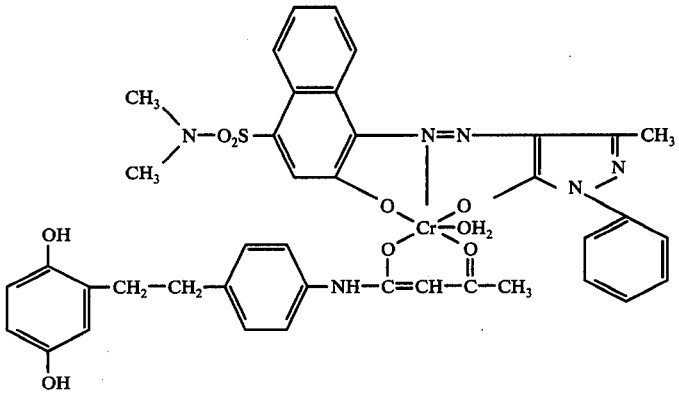
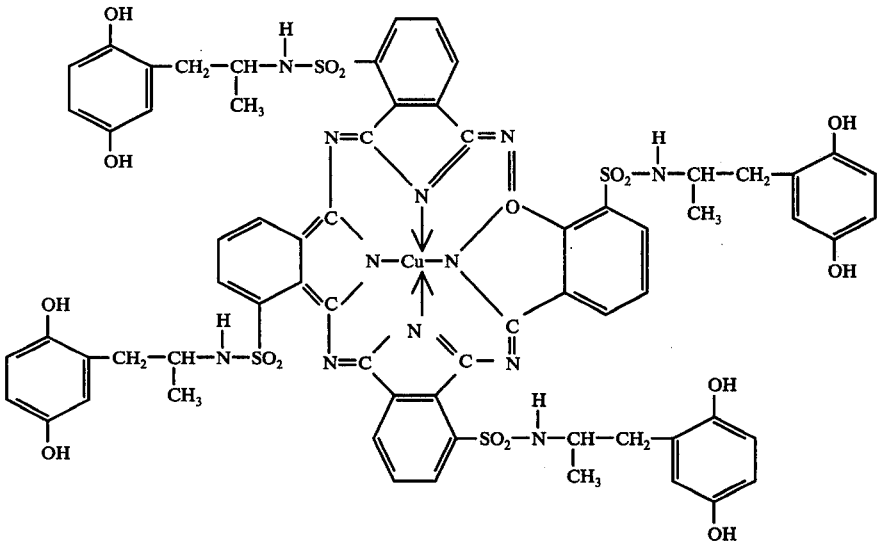
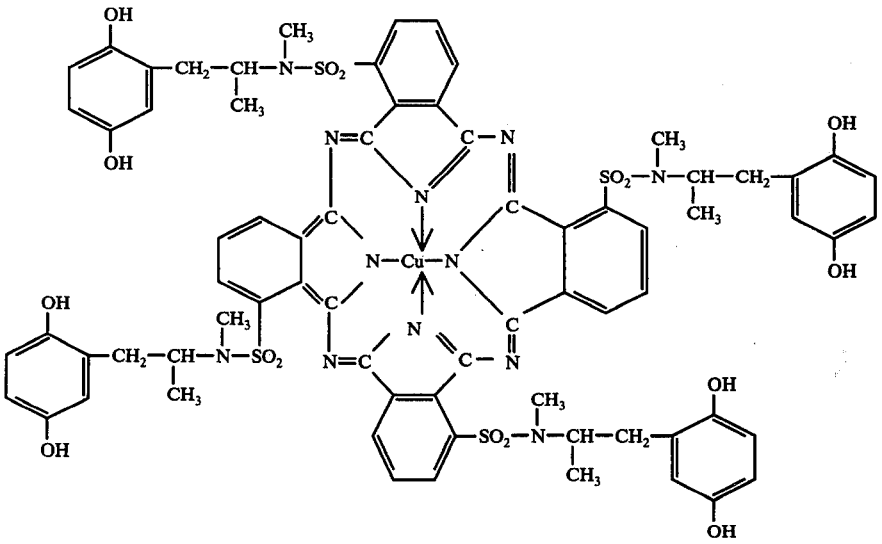

-continued

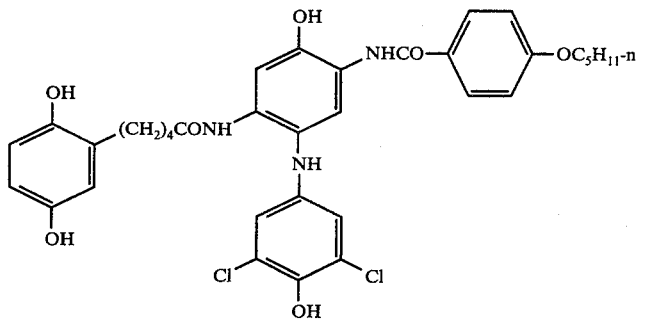

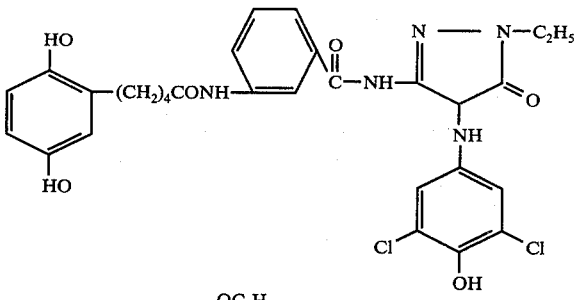

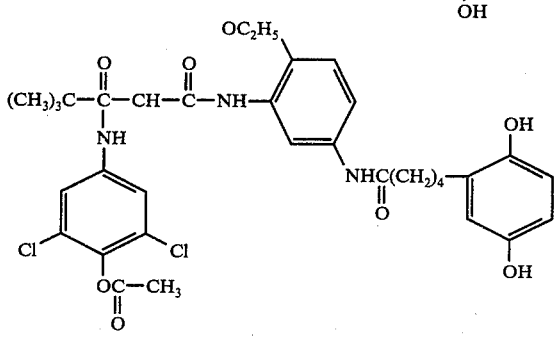

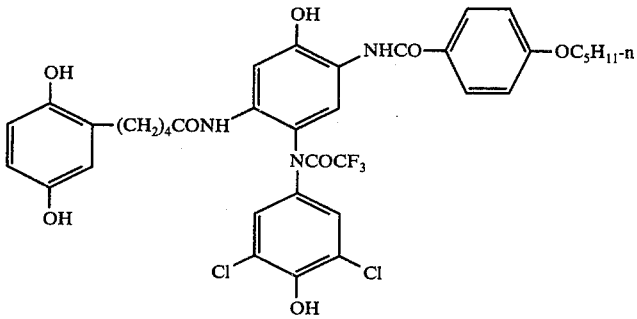

The light-sensitive element comprises therein the aforementioned silver halide emulsion layers in combination with these dye developers. In case the light-sensitive element is used in multi-color photographic process according to subtraction method, blue-sensitive, green-sensitive and red-sensitive silver halide emulsions are associated with yellow, magenta and cyan dye developers, respectively. Particularly preferably, such emulsions may be used respectively in combination with shorter-wavelength-shift dye developers, whose light absorption spectra have been individually shifted to shorter wavelength. The light-sensitive element having a preferable multi-coated construction is such as coated successively on the surface from the exposure side with a blue-sensitive emulsion, a green-sensitive emulsion and a red-sensitive emulsion in this order, and a yellow filter layer may be provided between the blue-sensitive emulsion layer and the green-sensitive emulsion layer.

When the light-sensitive silver halide emulsion is used in combination with the dye developer in the light-sensitive element, said emulsion and said dye developer may be present in separate layers adjacent to each other. Since a shorter-wavelength-shift type dye developer does not desensitize the emulsion, such dye developer may be incorporated into the silver halide emulsion layer.

The dye developer used in the present invention is dissolved in an organic solvent in an amount as small as possible, and the resulting solution is dispersed in a hydrophilic protective colloid such as gelatin or polyvinyl alcohol which is a carrier for the silver halide emulsion layers or the layers adjacent thereto in the light-sensitive element. As the organic solvent for the present dye developer, there may be used a high boiling solvent alone or a low boiling solvent capable of being removed by evaporation from the dispersion in combination with said high boiling solvent. A process disclosed in Japanese patent publication No. 13837/1968 may be adopted in dispersing the dye developer of the present invention. As particularly useful high boiling solvents in the present invention, there may be mentioned N-n-butylacetanilide, diethyllaurylamide, dibutyllaurylamide, dibutylphthalate and tricresyl phosphate. Usable as low boiling solvents, are ethyl acetate, methyl acetate and 4-methylcyclohexanone. As disclosed in U.S. Pat. Nos. 3,438,775 and 3,832,173, moreover, the dye developer used in the present invention may be dispersed in the form of fine grains directly in a water-soluble colloid without using any high boiling solvents.

The amount of the dye developer used in the present invention may be widely varied according to the kind of compounds used and the results desired. However, the dye developer is preferably used, for example, in an amount of about 0.5 to about 10% by weight based on the weight of a water-soluble organic colloid coating liquid to be coated.

In case a method of three-color photography is carried out, intermediate layers are advantageously used in the light-sensitive element. Besides gelatin, polyacrylamide, partial hydrolyzed polyvinyl acetate, the intermediated layer is composed of a porous polymer formed from a hydrophilic polymer and a latex of hydrophobic polymer disclosed in U.S. Pat. No. 3,625,685.

As a support of the light-sensitive element of the present invention, there may be used various materials, for example, paper, glass or natural or synthetic polymers such as cellulose nitrate, cellulose acetate, polyvinyl acetal, polystyrene, polyethylene terephthalate, polypropylene or polyethylene, and these materials may be either transparent or opaque according to the end use thereof.

The light-sensitive element as fully described hereinbefore is preferably laid on the top of an image-receiving element as will be described hereinafter, and is generally processed by spreading an alkaline processing solution of the present invention as will be mentioned later between the two elements.

The image-receiving element which mordants the dye developer diffusion-transferred thereto from the light-sensitive element and may be suitably selected according to the object thereof as will be described hereinafter.

The image-receiving element and the light-sensitive element may be coated either on the same support, or on separate supports. In the latter case, as a support of the image-receiving elements, there may be used, according to the object, various materials similar to those used as the supports for the light-sensitive elements. The supports for the image-receiving elements may also be either transparent or opaque.

The image-receiving element must have indispensably a mordant-containing layer, that is an image-receiving layer. As mordants suitable for use in an image-receiving layer of the image-receiving element, there may be used any mordants so long as they have preferable mordant effects on the dye developer which is diffusion-transferred thereto from the light-sensitive element. However, the mordants which are useful for the dye developer of the present invention include, for example, poly-4-vinylpyridine, cetyltrimethylammonium bromide and the like. Such mordants as disclosed in U.S. Pat. No. 2,882,156 and Belgian Pat. No. 729,202 are advantageously usable in the present invention. As a dispersant for the above-mentioned mordants, there may be used gelatin, polyvinyl alcohol and the like.

After substantial completion of the formation of a dye image, wherein the dye developer in the unexposed area has been diffusion-transferred to the image-receiving layer by the application of the alkaline processing solution, it is necessary that the pH in a film unit comprising the light-sensitive element and the image-receiving layer is decreased to the vicinity of neutral pH so as to increase the transferred dye developer in its stability and, at the same time, to prevent a further formation of dye image, in fact, and to prevent image discoloration or staining which may be caused at high pH. For this reason, a neutralization layer containing a substance capable of sufficiently lowering the pH is advantageously incorporated into the image-receiving element or the light-sensitive element. As the substance usable in the neutralization layer, for example, such polymer acid as disclosed in U.S. Pat. No. 3,362,819 or its partial ester or its acid anhydride, or such solid acid metal salts as disclosed in U.S. Pat. No. 2,584,030 may be useful in the present invention.

Further, a spacer layer is preferably used in the image-receiving element in order to control a lowering speed of the pH. For the preparation of such a spacer layer, there may be used such materials as gelatin, hydroxypropyl cellulose, an acryl latex, polyacrylamide and the mixtures thereof.

In addition thereto, the image-receiving element may be incorporated with various additives commonly used in the art of photography, such as ultraviolet absorbers or fluorescent brightening agents.

In the present invention, it is a characteristic feature that the alkaline processing solution containing a compound represented by the aforementioned general formula is allowed to act on the aforesaid light-sensitive element containing the aforementioned dye developer, which element has been subjected to imagewise exposure, and the above-mentioned image-receiving element placed upon the light-sensitive element. As representatives of the compound of the aforementioned general formula, which compound is to be incorporated into the alkaline processing solution, there may be mentioned those as exemplified below.

[I] Benzyl alcohol
[II] 3-Methylbenzyl alcohol
[III] 2-Ethylbenzyl alcohol
[IV] 4-Methoxybenzyl alcohol
[V] Methylphenylcarbinol
[VI] Ethylphenylcarbinol
[VII] p-Xylenediol In the present invention, the amount of the compound represented by the aforementioned general formula is not critical, but it is generally from 0.1 to 20% by volume, preferably from 1 to 10% by volume, based on the alkaline processing solution.

The alkaline processing solution used in the present invention has a strong alkalinity and, generally, contains a hydroxide ion of pH 12 or higher. The alkaline processing solution used in the present invention contains a hydroxide of alkali metals or alkaline earth metals, for example, sodium hydroxide, potassium hydroxide, calcium hydroxide or lithium hydroxide. The processing solution may also be incorporated with such development inhibitor as benzotriazole, and further with such compounds as hydroxyethyl cellulose and carboxymethyl cellulose sodium salts, which are used as viscosity-increasing agents.

In the present invention, the processing solution is desirably incorporated with such onium compound as a quaternary ammonium salt. Particularly useful onium compounds in the present invention include such preferred compounds as 1-benzyl-2-picolinium bromide and 1-phenethyl-2-picolinium bromide as disclosed in U.S. Pat. Nos. 3,411,904 and 3,173,786 may be usable in the present invention.

The onium compounds include quaternary ammonium compounds, quaternary phosphonium compounds and tertiary sulphonium compounds.

Typical onium compounds that can be utilized in the present invention are as follows.

1-benzyl-2-picolinium bromide
1-(3-bromopropyl)-2-picolinium-p-toluenesulfonate
1-phenethyl-2-picolinium bromide
1-γ-phenylpropyl-2-picolinium bromide
2,4-dimethyl-1-phenethylpyridinium bromide
2,6-dimethyl-1-phenethylpyridinium bromide
5-ethyl-2-methyl-1-phenethylpyridinium bromide
α-picoline-β-naphthoylmethylbromide
1-β-phenylcarbamoyloxyethyl-2-picolinium bromide
anhydro-1-(4-sulfobutyl)-2-picolinium hydroxide
2-ethyl-1-phenethylpyridinium bromide
1-[3-(N-pyridinium bromide)propyl]-2-picolinium-p-toluene-sulfonate
1-methyl-2-picolinium-p-toluenesulfonate
1-phenethyl-2,4,6-trimethylpyridinium bromide
1-phenethyl-4-n-propylpyridinium bromide
4-γ-hydroxypropyl-1-phenethylpyridinium bromide
1-n-heptyl-2-picolinium bromide
2-isopropyl-1-phenethylpyridinium bromide
tetraphenylammonium bromide
tetraethylammonium bromide
N-ethylpyridinium bromide
N,N-diethylpiperidinium bromide
ethylene-bis-pyridinium bromide
1-phenethyl-3-picolinium bromide
cetyltrimethylammonium bromide
polyethylene oxide bis-pyridinium perchlorate
3-methyl-2-ethylisoquinolium bromide
3-methylisoquinolinium methyl-p-toluenesulfonate
1-ethyl-2-methyl-3-phenethylbenzimidazolium bromide
5,6-dichloro-1-ethyl-2-methyl-3-(3-sulfobutyl)benzimidazolium betaine
lauryldimethylsulfonium-p-toluenesulfonate
nonyldimethylsulfonium-p-toluenesulfonate
octadimethylsulfonium-p-toluenesulfonate
butyldimethylsulfonium bromide
triethylsulfonium bromide
dodecyldimethylsulfonium-p-toluenesulfonate
decyldimethylsulfonium-p-toluenesulfonate
phenyldimethylsulfonium bromide
phenethyldimethylsulfonium bromide
tetraethylphosphonium bromide
ethylene-bis-oxymethyltriethylphosphonium bromide
tetraphenylphosphonium bromide
phenethyltrimethylphosphonium bromide The onium compounds can be used in a wide range of concentrations. Typical useful amounts of the onium compounds in the alkaline processing solution is 0.5 to 15% by volume.

Further, the processing solution may contain titanium dioxide as a light reflecting agent. As the method of reflecting light in viewing the image on the image-receiving element, there may be employed such methods as disclosed in Japanese Laid-Open-to-Public publications Nos. 486/1971 and 477/1972. The processing solution may also be incorporated with, as opacifying agents, carbon black or such indicator dyes as disclosed in Japanese Laid-Open-to-Public publications Nos. 26/1973, 27/1972 and 28/1972.

Into either the light-sensitive element, image-receiving element or processing solution can be incorporated such development inhibitors as 1-phenyl-5-mercaptotetrazole and benzylamino purine.

In the present invention, it is also advantageous to incorporate auxiliary developing agent, such as p-tolylhydroquinone or Phenidone into either the light-sensitive element, the image-receiving element or the processing solution. Such auxiliary developing agents as disclosed in Japanese patent publication No. 17383/1960, U.S. Pat. Nos. 2,939,788, 3,192,044 and 3,462,266, British Pat. No. 1,243,539, Japanese Laid-Open-to-Public publications Nos. 40128/1974, 83440/1974, 84238/1974 and 6340/1974 may be advantageously usable in the present invention. Examples of these auxiliary developing agents described in the above specifications are:

1-phenyl-3-pyrazolidone,
phenoxyhydroquinone,
toluhydroquinone,
4'-aminophenethylhydroquinone,
m-xylohydroquinone,
2-p-toluthiohydroquinone,
5,8-dihydro-1,4-naphthohydroquinone,
5,6,7,8-tetrahydro-1,4-naphtohydroquinone,
phenylhydroquinone,
p-aminophenylhydroquinone,
2,6-dimethylhydroquinone,
4'-methylphenylhydroquinone,
2-(4'-aminophenyl)-5-methylhydroquinone,
1,4-dihydroxy-naphthalene,
2,5-dichlorohydroquinone,
2,5-diisopropylhydroquinone,
dodecylhydroquinone,
2,5-dioctylhydroquinone,
4-methylcatechol,
3-isopropylcatechol.

The auxiliary developing agent may be incorporated into the light-sensitive element or image-receiving element in such a manner that said agent is dissolved in an organic solvent and the resulting solution is then dispersed in said light-sensitive element or said image-receiving element. As the organic solvent used in the above case, there may be used a high boiling solvent alone or a combination of a low boiling solvent capable of being removed by evaporation from the dispersion and said high boiling solvent. As the useful high boiling solvents, there may be mentioned diethyllaurylamide, dibutyllaurylamide, dibutylphthalate, N-n-butylacetanilide, tricresyl phosphate and the like. In the manner as described in Japanese Laid-Open-to-Public publication No. 131134/1974, the auxiliary developing agent may be incorporated in a homogeneous state into the image-receiving element.

The amount of the auxiliary developing agent to be added in the light-sensitive or image-receiving element is 2 to 30 m mole/$m^2$ and the amount in the processing solution is 3 to 15% by volume.

In accordance with the present invention, the light-sensitive element containing the dye developer, which element has been subjected to imagewise exposure as aforesaid, and the image-receiving element are subjected in their state of being placed one upon the other to the action of the alkaline processing solution containing the compound represented by the aforementioned general formula. Hence, in the film unit used in the present invention, the light-sensitive element may be present, prior to exposure to light, apart from the image-receiving element, or they may be combined in one united body. After development treatment, the light-sensitive element may be still combined with the image-receiving element in one united body, or the two elements may be peeled from each other. Such film units as disclosed in U.S. Pat. Nos. 3,415,644; 3,415,645; 3,415,646; 3,473,925; 3,573,042; 3,573,043; 3,594,164; 3,594,165 and 3,615,421, Belgian Pat. Nos. 757959 or 757960 may also usable in the present invention.

The present invention is illustrated below with reference to examples, but the invention is not intended to be limited thereto.

EXAMPLE 1

A light-sensitive element was prepared by successively coating the following layers on an acetylcellulose film support subbed on the surface with gelatin.

(1) Cyan dye developer layer 1,4-bis(α-Methyl-β-hydroxynonylpropylamino)-5,8-dihydroxyanthraquinone was dissolved in a mixture of N-n-butylacetanilide and 4-methyl-cyclohexanone and the resulting solution was emulsified by dispersing it in an aqueous gelatin solution containing Alkanol B. The emulsified dispersion was coated on the support so that the amount of gelatin became 4.2 g/m$^2$ and that of the cyan dye developer 2.0 g/m$^2$ in the resulting layer.

(2) Red-sensitive emulsion layer

A red-sensitive silver iodobromide emulsion was coated on the cyan dye developer layer so that the amount of silver became 0.6 g/m$^2$ and that of gelatin 2.4 g/m$^2$ in the resulting layer.

(3) Intermediate layer

An intermediate layer was coated on the red-sensitive emulsion layer by coating gelatin thereon so that the amount of the gelatin became 2.0 g/m$^2$ in the resulting layer.

(4) Magenta dye developer layer

2-[p-(β-hydroxynonylethyl)phenylazo]-4-n-propoxy-1-naphthol was dissolved in a mixture of N-n-butylacetanilide and 4-methylcyclohexanone and the resulting solution was emulsified by dispersing it in an aqueous gelatin solution containing Alkanol B as a dispersing agent. The emulsified dispersion was coated on the intermediate layer so that the amount of gelatin became 2.8 g/m$^2$ and that of the magenta dye developer 1.3 g/m$^2$ in the resulting layer.

(5) Green-sensitive emulsion layer

A green-sensitive silver iodobromide emulsion was coated on the magenta dye developer layer so that the amount of silver became 1.2 g/m$^2$ and that of gelatin 1.2 g/m$^2$ in the resulting layer.

(6) Intermediate layer

An intermediate layer was coated on the green-sensitive emulsion layer by coating gelatin thereon so that the amount of the gelatin became 1.5 g/m$^2$ in the resulting layer.

(7) Yellow dye developer layer

1-Phenyl-3-N-n-hexylcarboxyamide-4-[p-(2',5'-dihydroxyphenethyl)phenylazo]-5-pyrazolone was dissolved in a mixture of N,N-diethyllaurylamide and ethyl acetate and the resulting solution was emulsified by dispersing it in an aqueous gelatin solution containing Alkanol B. The emulsified dispersion was coated on the intermediate layer so that the amount of gelatin became 1.1 g/m$^2$ and that of the yellow dye developer 0.5 g/m$^2$ in the resulting layer.

(8) Blue-sensitive emulsion layer

A blue-sensitive silver iodobromide emulsion was coated on the yellow dye developer layer so that the amount of silver became 0.6 g/m$^2$ and that of gelatin 0.6 g/m$^2$ in the resulting layer.

(9) Protective layer

A solution of 4'-methylphenylhydroquinone in N,N-diethyllaurylamide was emulsified by dispersing it in an aqueous gelatin solution to prepare a coating liquid. Into 100 ml of the coating liquid was incorporated 5 ml of a 2% mucochloric acid and the resulting mixture was coated on the blue-sensitive emulsion layer so that the amount of 4'-methylphenylhydroquinone became 0.5 g/m$^2$ and that of gelatin 0.6 g/m$^2$ in the resulting layer.

The light-sensitive element thus prepared was exposed to light through an optical wedge using red, green and blue filters. The exposed light-sensitive element was then placed on the below-mentioned image-receiving element and the resulting assembly was subjected to development treatment using any one of the following processing solutions [A], [B]]and [C].

Processing Solution [A]

| | | |
|---|---|---|
| Water | 100 | ml |
| Potassium hydroxide | 11.2 | g |
| Carboxymethylcellulose | 3.5 | g |
| Benzotriazole | 3.0 | g |
| N-Phenethyl-α-picolinium bromide | 2.0 | g |
| Benzyl alcohol | 1 | ml |

Processing Solution [B]

This processing solution had the same composition as in the processing solution [A], except that methylphenylcarbinol was used in place of the benzyl alcohol used in the processing solution [A].

Processing solution [C]

This processing solution had the same composition as in the processing solution [A], except that the benzyl alcohol used in the processing solution [A] was excluded therefrom.

Image-receiving element

In a mixture of ½ part of glacial acetic acid and 150 parts of water were dissolved 1 part of glacial acetic acid and 2 parts of polyvinyl alcohol. The resulting solution was further charged with 1/20 part of 1-phenyl-5-mercaptotetrazole and then coated on a baryta paper to prepare the image-receiving element.

After the lapse of a 45-second processing, the light-sensitive element was peeled off from the image-receiving element. The maximum density (D max) and the minimum density (D min) of each of the dye images obtained on the image-receiving element were measured. In the case of development of the assembly with the processing solution [C], moreover, the measurement of D max and D min was likewise conducted after the lapse of a 90-second processing. The results obtained were as shown in Table 1.

Table 1

| Processing solution | Processing time (sec.) | D max | | | D min | | |
|---|---|---|---|---|---|---|---|
| | | Blue | Green | Red | Blue | Green | Red |
| [A] | 45 | 2.05 | 2.12 | 2.08 | 0.26 | 0.19 | 0.16 |
| [B] | 45 | 2.07 | 2.10 | 2.10 | 0.25 | 0.10 | 0.17 |
| [C] | 45 | 1.72 | 1.65 | 1.53 | 0.22 | 0.15 | 0.12 |
| [D] | 90 | 1.98 | 2.06 | 2.10 | 0.24 | 0.15 | 0.13 |

From the results shown in Table 1, it is understood that when the assembly was processed with the processing solution [A] as well as the processing solution [B] of the present invention, the respective D max values greatly increase. In the case where the processing solution [C] was used, it is understood that the processing time necessary for obtaining image densities substantially equal in value to those obtained by use of the processing solution [A] as well as [B] of the present invention becomes twice that of said processing solution [A] as well as [B], and hence that the processing time may be greatly shortened according to the present invention.

EXAMPLE 2

A light-sensitive element was prepared by successively coating the following layers on an acetylcellulose film support subbed on the surface with gelatin.

(1) Magenta dye developer layer

2-[p-(2',5'-Dihydroxyphenylethyl)phenylazo]-4-n-propoxy-1-acetoxynaphthalene was dissolved in a mixture of N,N-diethyllaurylamide and ethyl acetate solvent mixture and the resulting solution was emulsified by dispersing it in an aqueous gelatin solution containing a dispersing agent Alkanol B. The emulsified dispersion was coated on the support so that the amount of gelatin became 2.8 g/m$^2$ and that of the dye developer 1.4 g/m$^2$ in the resulting layer.

(2) Green-sensitive emulsion layer

A green-sensitive silver iodobromide emulsion was coated on the magenta dye developer layer so that the amount of silver became 1.2 g/m$^2$ and that of gelatin 1.3 g/m$^2$ in the resulting layer.

(3) Protective layer

4'-Methylphenylhydroquinone was dissolved in N,N-diethyllaurylamide and the resulting solution was emulsified by dispersing it in an aqueous gelatin solution to prepare a coating liquid. Into 100 ml of the coating liquid was incorporated 5 ml of a 2% mucochloric acid and the resulting coating liquid was coated on the green-sensitive emulsion layer so that the amount of 4'-methylphenylhydroquinone became 0.2 g/m$^2$ and that of gelatin 0.6 g/m$^2$ in the resulting layer.

An image-receiving element was prepared by successively coating the following layers on an acetylcellulose film support.

(1) Neutralization layer

A partial butyl ester of a polyethylene/maleic anhydride copolymer obtained by refluxing for 14 hours 300 g of highly viscous poly(ethylene/maleic anhydride), 140 g of n-butyl alcohol and 1 ml of a 85% phosphoric acid was coated on the support so that the resulting layer came to have a thickness of 19 $\mu$.

(2) Spacer layer

An aqueous solution of hydroxypropylcellulose was coated on the neutralization layer so that the resulting layer came to have a thickness of 1.9 $\mu$.

(3) Image-receiving layer

A mixture of 1 part of poly-4-vinylpyridine and 2 parts of polyvinyl alcohol was coated on the spacer layer so that the resulting layer came to have a thickness of 10 $\mu$.

The image-receiving element thus prepared was placed on the aforesaid light-sensitive element to form an assembly and the resulting assembly was exposed to light through an optical wedge from the image-receiving element side through a green filter. The assembly was subjected to development treatment using any one of the following processing solutions [D], [E], [F] and [G]. The image-receiving element was measured for its reflection densities without peeling off said image-receiving element from the light-sensitive element. The results obtained were as shown in Table 2.

Processing solution [D]

| | | |
|---|---|---|
| Water | 100 | ml |
| Potassium hydroxide | 11.2 | g |
| Carboxymethylcellulose | 3.5 | g |
| Benzotriazole | 3.0 | g |
| N-Phenethyl-α-picolinium bromide | 2.0 | g |
| Titanium dioxide | 40.0 | g |
| 3-Methylbenzyl alcohol | 1 | ml |

Processing solution [E]

This processing solution had the same composition as in the processing solution [D], except that p-xylenediol was used in place of the 3-methylbenzyl alcohol used in the processing solution [D].

Processing solution [F]

This processing solution had the same composition as in the processing solution [D], except that the 3-methylbenzyl alcohol used in the processing solution [D] was excluded therefrom.

Processing solution [G]

This processing solution had the same composition as in the processing solution [D], except that 4-isopropylbenzyl alcohol as a control compound was used in place of the 3-methylbenzyl alcohol used in the processing solution [D].

Table 2

| Processing solution | D max | D min |
|---|---|---|
| [D] | 2.13 | 0.16 |
| [E] | 2.17 | 0.18 |
| [F] | 1.53 | 0.13 |
| [G] | 1.64 | 0.15 |

As is clear from Table 2, it is understood that when the assembly was processed with the processing solution [D] as well as the processing solution [E] of the present invention, their respective D max values increase. Further, 4-isopropylbenzyl alcohol is structurally similar to the compounds having the aforementioned general formula. However the processing solution [G] does not cause the increase of D max, so it is clearly understood that only the processing solutions comprising the compounds having the aforementioned formula bring superior results.

What we claim is:

1. In a process for forming a color dye image in an image-receiving layer by diffusion transfer from a light-sensitive element comprising a silver halide emulsion and a diffusible dye developer which process comprises; image-wise exposing the light-sensitive element to light, subjecting the exposed light-sensitive element to an alkaline processing solution to correspondingly form an image of a diffusible dye developer in the light-sensitive element, and transferring, by diffusion, the diffusible dye developer from the light-sensitive element to the receiving layer superimposed thereon during the subjecting step to form the color dye image in the receiving layer, the improvement which comprises the alkaline processing solution containing a compound represented by the formula

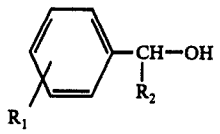

wherein $R_1$ represents hydrogen, methyl, ethyl, methoxy or hydroxymethyl and $R_2$ represents hydrogen, methyl or ethyl.

2. A process according to claim 1, wherein the compound of the formula is selected from the group consisting of benzyl alcohol, 3-methylbenzyl alcohol, 2-ethylbenzyl alcohol, 4-methoxybenzyl alcohol, methylphenylcarbinol, ethylphenylcarbinol and p-xylenediol.

3. A process according to claim 1, wherein the amount of the compound of the formula is 0.1 to 20% by volume of the solution.

4. A process according to claim 1, wherein the solution further comprises an auxiliary developing agent.

5. A process according to claim 1, wherein the solution further comprises a quaternary ammonium compound, a quaternary phosphonium compound or a tertiary sulphonium compound.

6. A process according to claim 1, wherein the solution further comprises hydroxyethyl cellulose or carboxymethyl cellulose sodium salt.

* * * * *